US007988478B2

(12) United States Patent
Wang

(10) Patent No.: US 7,988,478 B2
(45) Date of Patent: Aug. 2, 2011

(54) SECURITY SOCKET AND SOCKET DEVICE HAVING THE SAME

(75) Inventor: Chu-Li Wang, Taipei (TW)

(73) Assignee: Emcom Technology Inc., Taipei (TW)

( * ) Notice: Subject to any disclaimer, the term of this patent is extended or adjusted under 35 U.S.C. 154(b) by 0 days.

(21) Appl. No.: 12/647,568

(22) Filed: Dec. 28, 2009

(65) Prior Publication Data

US 2011/0097919 A1 Apr. 28, 2011

(30) Foreign Application Priority Data

Oct. 23, 2009 (TW) ..... 98136027 A

(51) Int. Cl.
*H01R 13/62* (2006.01)

(52) U.S. Cl. ..... 439/304; 439/500

(58) Field of Classification Search ..... 439/133, 439/304, 344, 500, 550
See application file for complete search history.

(56) References Cited

U.S. PATENT DOCUMENTS

| | | | | |
|---|---|---|---|---|
| 4,647,726 | A * | 3/1987 | Blum | 379/435 |
| 5,637,002 | A * | 6/1997 | Buck et al. | 439/148 |
| 7,354,291 | B2 * | 4/2008 | Caveney et al. | 439/344 |
| 7,722,378 | B2 * | 5/2010 | Morrison et al. | 439/344 |

* cited by examiner

*Primary Examiner* — Thanh Tam Le

(57) ABSTRACT

A security socket for use with a panel having at least one assembly hole is provided. The security socket includes a data socket and a security unit. The socket has a slot and is connected to the assembly hole of the panel in a direction toward the inner surface of the panel. The security unit engages with the socket in a direction toward the outer surface of the panel. The security unit has a protrusion and a through hole corresponding to the slot of the socket, and the protrusion perpendicularly extends from the surface of the through hole, wherein the protrusion further has an insertion hole penetrating through a bottom of the protrusion.

18 Claims, 7 Drawing Sheets

SECURITY SOCKET AND SOCKET DEVICE HAVING THE SAME

This application claims priority based on a Taiwanese patent application No. 098136027 filed on Oct. 23, 2009, the disclosure of which is incorporated herein by reference in its entirety.

BACKGROUND OF THE INVENTION

1. Field of the Invention

The present invention relates to a connection socket. More particularly, the present invention relates to a connection socket with security function and a socket device having the same.

2. Description of the Prior Art

As the network system prevails and is widely applied in many fields, tremendous changes have brought to the traditional industries, manufacturing industries, retail business, medical and health market, etc. The development of information technology brings unforeseen innovations for business practice, work efficiency, and production quality. Internet facilities are generally employed in the office environment or commercial and residential properties, such as hotel, restaurant, or wholesale store.

However, in these public places, the network facility not only encounters the problem of transmission speed, but also suffers from environment contaminations, such as dust, humidity, insects, as well as EMI (electromagnetic interference). Even worse, the network facility may be damaged intentionally or inadvertently. As such, the network connection and the transmission task cannot be ensured in the network system. As FIG. 1 shows, a plug 30 of a conventional network cable is plugged into the socket hole 12 of the panel 10 to connect the socket 20 behind the panel 10.

As FIG. 1 shows, the plug 30 is inserted into the socket 20 without any security design. Particularly, the resilient portion 32 of the plug 30 can be freely pushed or compressed to be released from the interference with the panel 10, so that the plug 30 can easily unplugged from the socket 20. After the plug 30 is removed from the socket 20, the socket hole 12 and the socket 20 will encounter the abovementioned problems of dust, humidity, insects, or even intentional damage since the network cabling system is in a vulnerable condition.

In view of the above, when the network cabling system or the wiring panel is damaged, the repair works will be very time-consuming. In a severe case, the wall may need to be reconstructed to re-route the network cabling system. Therefore, in order to overcome the above problems and achieve other purposes, the present inventor sets forth the following design.

SUMMARY OF THE INVENTION

It is an objective of the present invention to provide a security socket for providing a security effect and a security socket device having the same.

It is another objective of the present invention to provide a security socket and a security socket device, wherein a security unit is provided to prevent the connection plug inserted into the socket from easily disassembling from the socket.

It is another objective of the present invention to provide a security socket and a security socket device capable of protecting the panel from damage.

It is a further objective of the present invention to provide a security socket and a security device, wherein a plug remover is provided.

It is another objective of the present invention to provide a security socket and a security socket device compatible with the existing socket panel or panel unit without the need of changing its mold or re-molding.

The present invention provides a security socket for use with a panel which has at least one assembly hole, an inner surface, and an outer surface. The security socket includes a data socket and a security unit. The socket is connected to the assembly hole of the panel in a direction toward the inner surface of the panel and has a slot. The security unit engages with the socket in a direction toward the outer surface of the panel. The security unit has a protrusion and a through hole corresponding to the slot, and the protrusion perpendicularly extends from the surface of the through hole, wherein the protrusion further has an insertion hole penetrating through a bottom of the protrusion. The protrusion further has a recess for accommodating a resilient portion of a connection plug.

In one embodiment, the security socket further includes a plug remover for inserting into the insertion hole. The shape of the plug remover corresponds to the shape of the insertion hole. That is to say, if the shape of the insertion hole includes V-shaped, T-shaped or other shapes, the plug remover has at least a portion corresponding to the specific shape of the insertion hole. In other embodiments, however, the shape of the insertion hole may not perfectly correspond to the shape of the insertion hole. The plug remover includes an inserting portion and a holding portion, wherein the dimension of the holding portion is preferably greater than or similar to the dimension of the inserting portion. The holding portion preferably has a rough surface for enhancing the holding strength, and the insertion hole is preferably a tilt-angled through hole communicating with the recess. When the plug remover is inserted into the insertion hole, the inserting portion pushes the resilient portion of the connection plug away from the recess, such that the connection plug can be disassembled from the slot of the socket. The security unit has at least one fastening portion, and the socket has at least one engaging portion for connecting with the fastening portion. The security unit further has at least one interfering portion, and the socket has at least one slit for engaging with the interfering portion.

The present invention further provides a security socket device including a panel unit, a socket, a security unit, and a plug remover. The panel unit has an assembly hole. The socket is assembled inwardly to the assembly hole and has a slot. The security unit is assembled outwardly with the assembly hole and engages with the socket. The security unit has a protrusion and a through hole corresponding to the slot. The protrusion perpendicularly extends from one side of the through hole. The protrusion further has an insertion hole, such that the plug remover can be inserted into the insertion hole to push the resilient portion of the connection plug to be disassembled from the socket.

In one embodiment, the shape of the plug remover corresponds to the shape of the insertion hole, and the panel unit may include jump panel, wire panel, or a housing of terminal box or wire-gathering box.

DETAILED DESCRIPTION OF THE PREFERRED EMBODIMENT

The present invention provides a security socket free from contamination and damage and also provides a security socket device having the same. The socket and the corresponding plug are preferably RJ-45, RJ-47, or other proper connection sockets or plugs for the communication network. In other embodiments, however, the socket and the corresponding plug can be used in telephone connector or other types of connectors such as USB, IEEE connectors, etc. In order to illustrate the present invention, various embodiments and structures thereof are described below with reference to the accompanied drawings.

Figure 1:
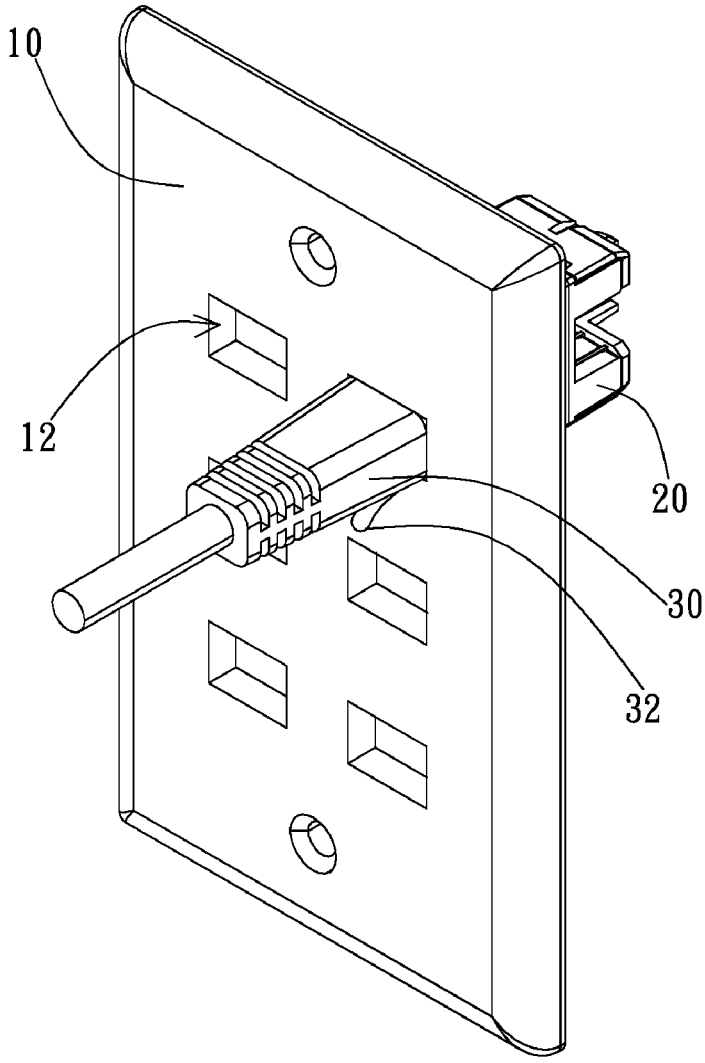
FIG. 1 (PRIOR ART)
FIG. 1 illustrates a perspective view of a plug of a communication cable plugged into a conventional socket.
Figure 2:
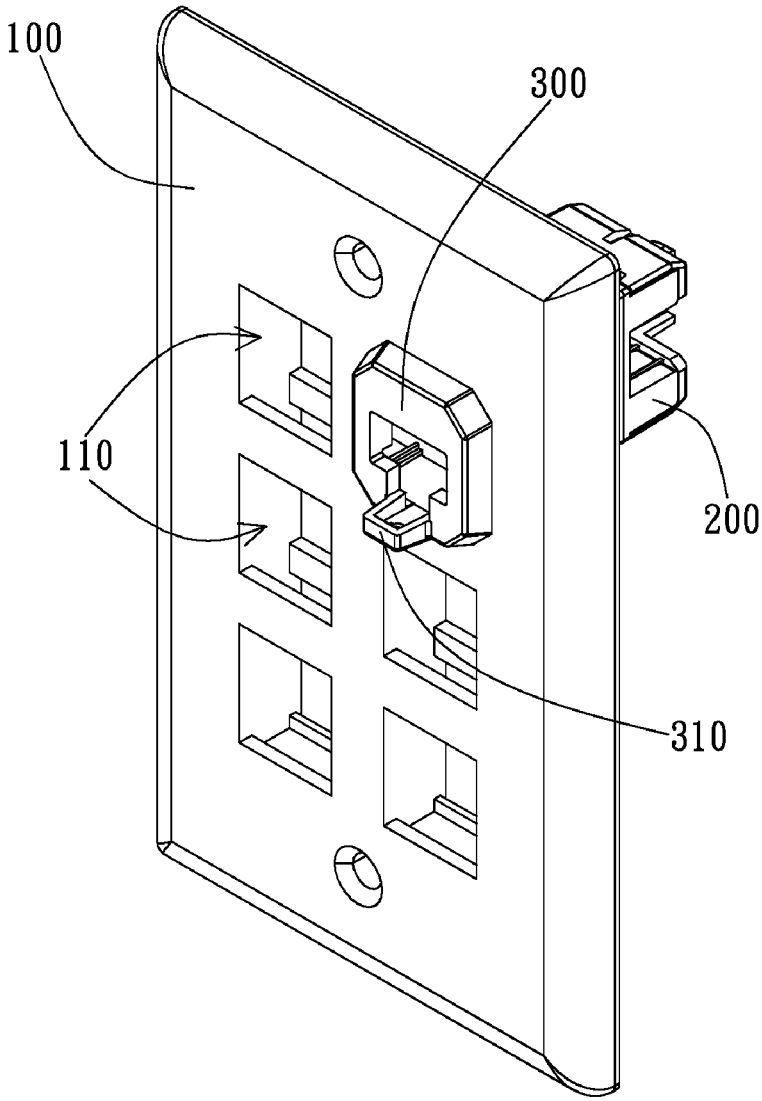
FIG. 2 illustrates a perspective view of a security socket assembled with a panel of the present invention.

As FIG. 2 shows, a security socket is provided for use with a panel 100 which has an assembly hole 110, an inner surface, and an outer surface. Generally, the panel 100 is preferably a patch panel. In other embodiments, however, the panel 100 can be a wire-gathering box or wall outlet. Thus, the panel 100 may have different sizes and types based on different application situations, and the number of the assembly hole 110 may be modified according to different design need. The security socket includes a data socket 200 and a security unit 300. The socket 200 is connected to the assembly hole 110 of the panel 100 in a direction toward the inner surface of the panel 100. That is, the socket 200 is disposed in the wall surface, on the rear side of the panel, or in the interior of the panel 100, but not limited thereto. The socket 200 further has a slot 210 (see FIG. 3) for receiving a corresponding plug (not illustrated). The security unit 300 is engages with the socket 200 in a direction toward the outer surface of the panel 100.

Figure 3:
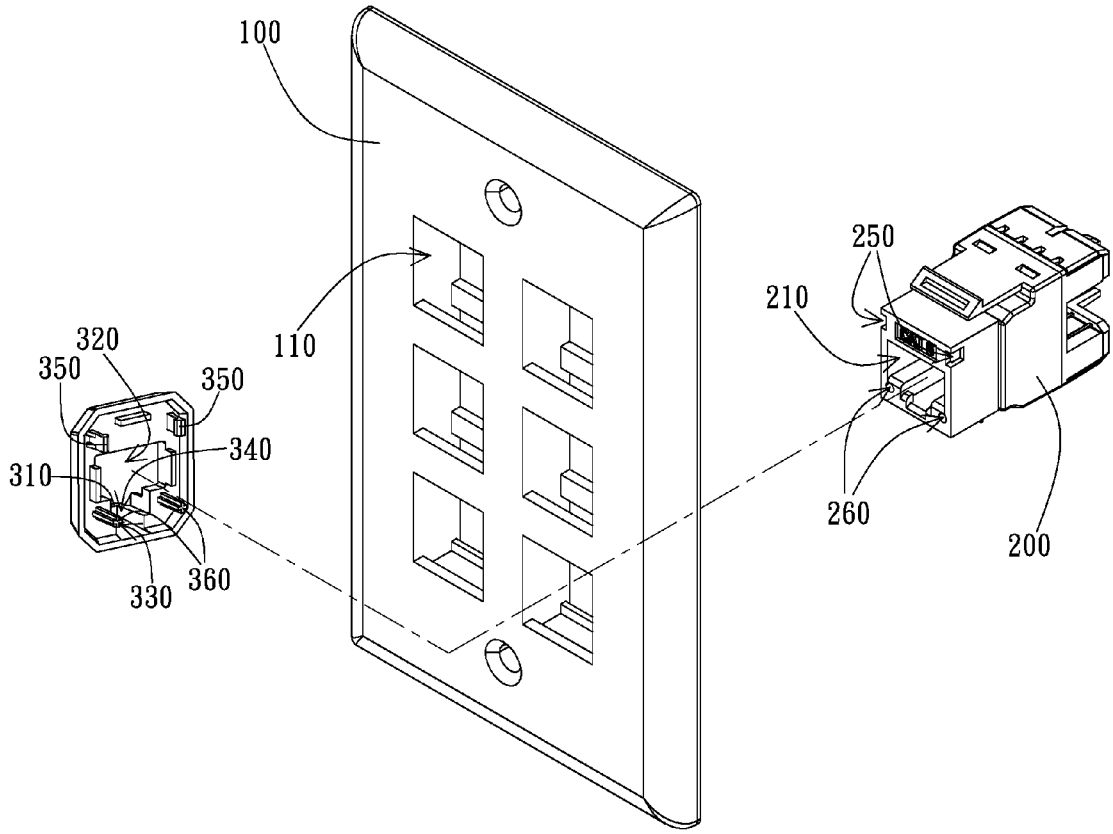
FIG. 3 illustrates a perspective view of a socket and a security unit of the present invention after disassembled.

As shown in FIG. 2 and FIG. 3, the security unit 300 has a protrusion 310 and a through hole 320. The through hole 320 corresponds to the assembly hole 110 and allows a connection plug (not shown) to pass through and to be plugged into the slot 210 of the socket 200. The protrusion 310 protrudes from the surface of the through hole 320 parallel to the insertion direction of the through hole 320. For example, in this embodiment, the protrusion 310 is a plate with a recess 340 for receiving the resilient portion of the connection plug and extends from the through hole 320. The protrusion 310 preferably protrudes perpendicular to the surface of the security unit 300, i.e., substantially perpendicular to the surface of the panel 100. The protrusion 310 further has an insertion hole 330 penetrating through a bottom of the protrusion 310. The insertion hole 330 preferably has a specific shape. In the embodiment shown in FIG. 3, the inner surface of the security unit 300 further includes a pair of fastening portions 350 and a pair of interfering portions 360. The pair of fastening portions 350 and the pair of interfering portions 360 are disposed closed to the through hole 320. The fastening portion 350 is preferably an extending arm having a hook end, and the interfering portion 360 is preferably a pillar protruding from the inner surface of the security unit 300. The socket 200 includes a set of engaging portions 250 and a set of cavity 260. The set of engaging portions 250 and the set of cavity 260 are disposed closed to the slot 210 of the socket 200 and correspond to the fastening portions 350 and the interfering portions 360, respectively. In order words, when the security unit 300 is assembled with the socket 200, each engaging portion 250 of the socket 200 can be engaged with each fastening portion 350 of the security unit 300, and each cavity 260 of the socket 200 can be engaged with each interfering portion 360 of the security unit 300.

In this embodiment, the engaging portion 250 is preferably a trough for engaging with the fastening portion 350. The interfering portion 360 is preferably a pillar with a tapered end for inserting into the slit 260. In other embodiments, however, the arrangement of the fastening portion 350 and the engaging portion 250 or the arrangement of the interfering portion 360 and the slit 260 can be interchanged with each other. That is, the fastening portion 350 or the interfering portion 250 can be provided on the socket 200 while the engaging portion 250 or the slit 260 is correspondingly provided on the security unit 300. Moreover, the number of these elements 350, 360, 250, 260 can be modified according to design requirement. Furthermore, the arrangement of the fastening portion 350 and the engaging portion 250 and the arrangement of the interfering portion 360 and the slit 260 can be used in combination or independently. Therefore, when the fastening potion 350 and the interfering portion 360 are respectively engaged with the engaging portion 250 and the slit 260 through the assembly hole 110 of the panel 100, the security unit 300 is not easily separated from the socket 200.

Figure 4:
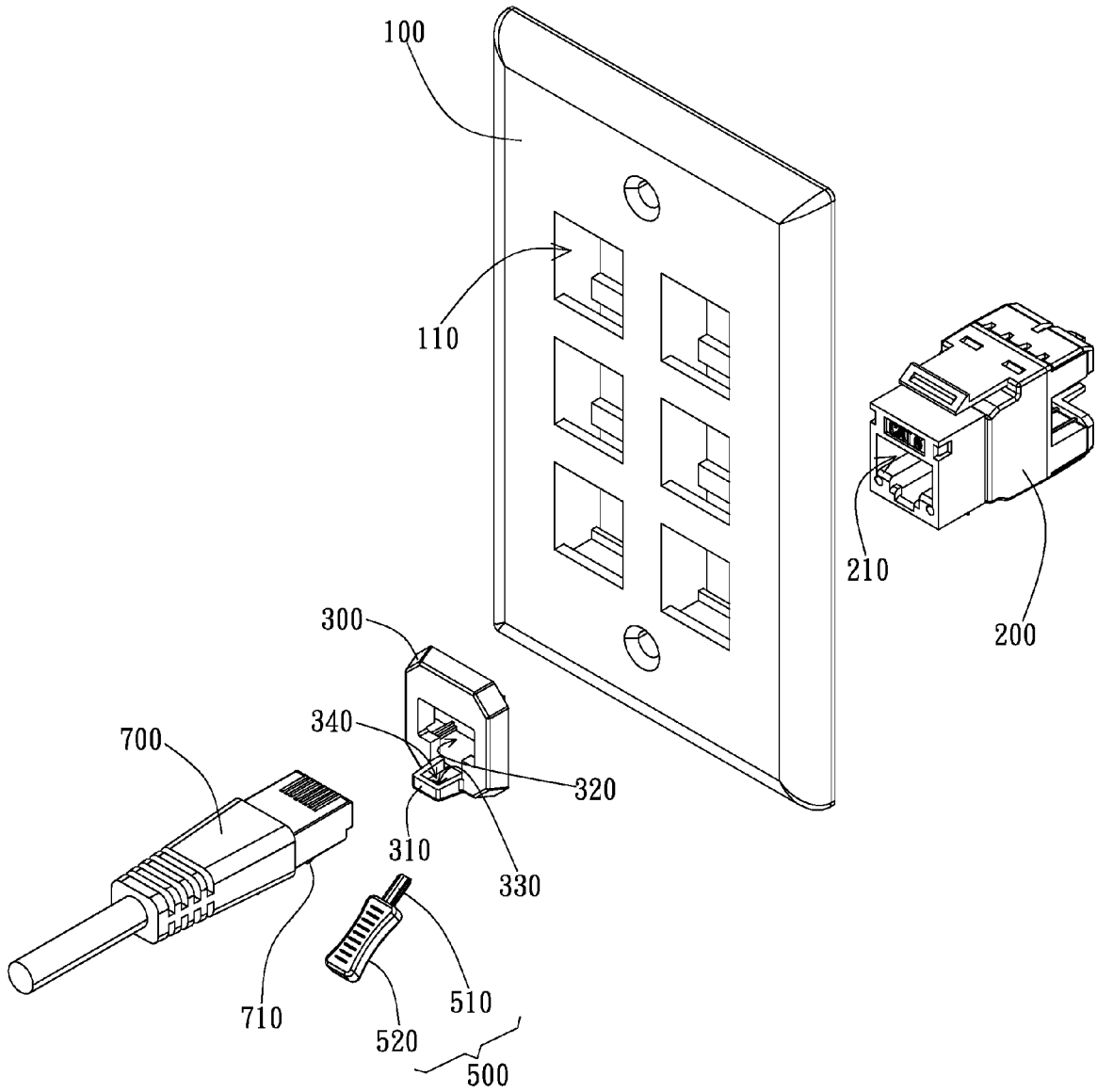
FIG. 4 illustrates a schematic view of the security socket and a plug remover of the present invention.

As FIG. 4 shows, a plug remover 500 is provided for inserting into the insertion hole 330 to remove the connection plug 700. The plug remover 500 preferably has a shape corresponding to the specific shape of the insertion hole 330. In other words, when the insertion hole 330 is designed to have a V shape, the shape of the plug remover 500 is preferably V-shaped to allow the plug remover 500 to be inserted into the insertion hole 330. In other embodiments, however, the shape of the insertion hole 330 can include T-shape, I-shape, L-shape, or any suitable geometric shape, such as triangle, star, etc. In some embodiments, the shape of the plug remover 500 may not perfectly correspond to the shape of the insertion hole 330. The plug remover 500 may have a shape allowable for inserting into the insertion hole 330. As shown in FIG. 4, the plug remover 500 includes an inserting portion 510 and a holding portion 520. The dimension of the holding portion 520 is preferably greater than or similar to the dimension of the inserting portion 510 to provide the user a comfortable holding feeling. In other embodiments, however, the plug remover 500 may only have the inserting portion 510 without the holding potion 520. In the embodiment, the inserting portion 510 is the portion of the plug remover 500 which has a shape corresponding to that of the insertion hole 310. The holding portion 520 preferably has a rough surface for increasing the holding strength. For example, in this embodiment, the holding portion 520 has a plurality of raised strips or recessed dints on two holding surfaces.

Figure 5A:
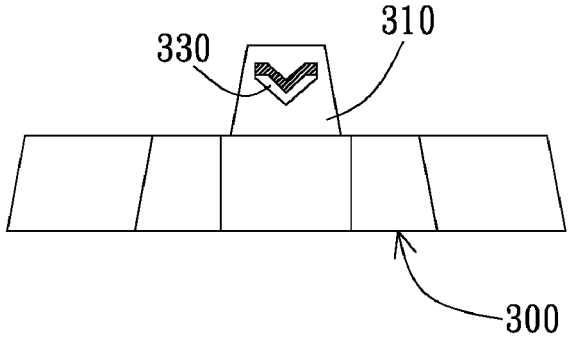
FIG. 5A illustrates a bottom view of an insertion hole of the security unit of the present invention.
Figure 5B:
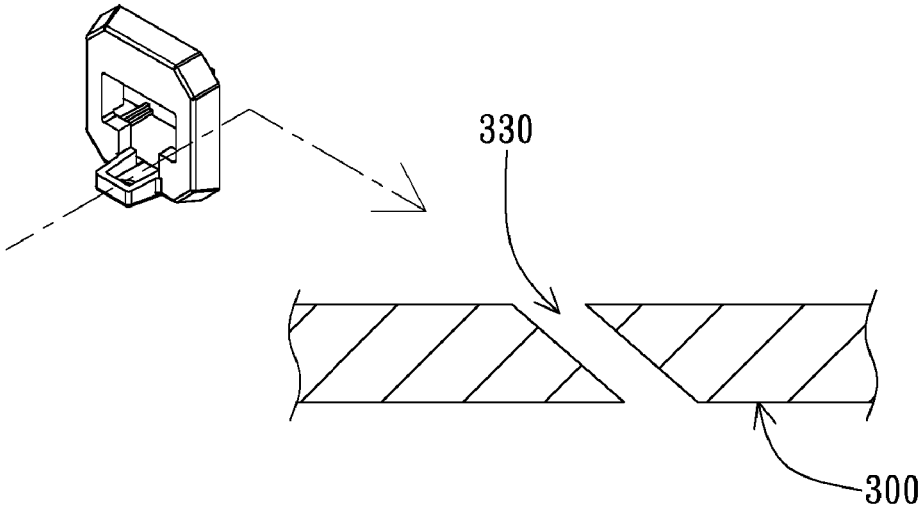
FIG. 5B illustrates a cross-sectional view of the insertion hole of the present invention.

As FIG. 5A and FIG. 5B show, the insertion hole 330 is disposed on the bottom of the protrusion 310 and communicates with the recess 340. The insertion hole 330 is preferably a tilt-angled through hole 330 which has a channel inclined with respect to the extending direction of the protrusion 210. In other words, if an insertion object does not correspond to the specific shape of the insertion hole 330, the insertion object has difficult passing through the insertion hole 330 to the recess 340. In the embodiment shown in FIG. 4 and FIG. 5A, when the connection plug 700 is plugged into the slot 210 of the socket 200, the resilient portion 710 of the connection plug 700 is received in the recess 340 of the security unit 300, so that the resilient portion 710 cannot be accessed or operated without the plug remover 500. Accordingly, the connection plug 700 cannot be separated from the socket 200. When intending to unplug the connection plug 700 from the slot 210 of the socket 200, the inserting portion 510 of the plug remover 500 is inserted into the insertion hole 330 to remove (e.g. push or compress) the resilient portion 710 of the connection plug 700 away from the recess 340, such that by pulling the connection plug 700, the connection plug 700 can be disassembled from the slot 210 of the socket 200.

Therefore, the design of the insertion hole 330 and the plug remover 500 provides the security function to prevent unauthorized users who do not have the suitable plug remover from inadvertently or intentionally separating the connection plug 700 from the socket 200. Consequently, the security effect prevents the socket 200 and the panel 100 from contamination or damage.

Figure 6:
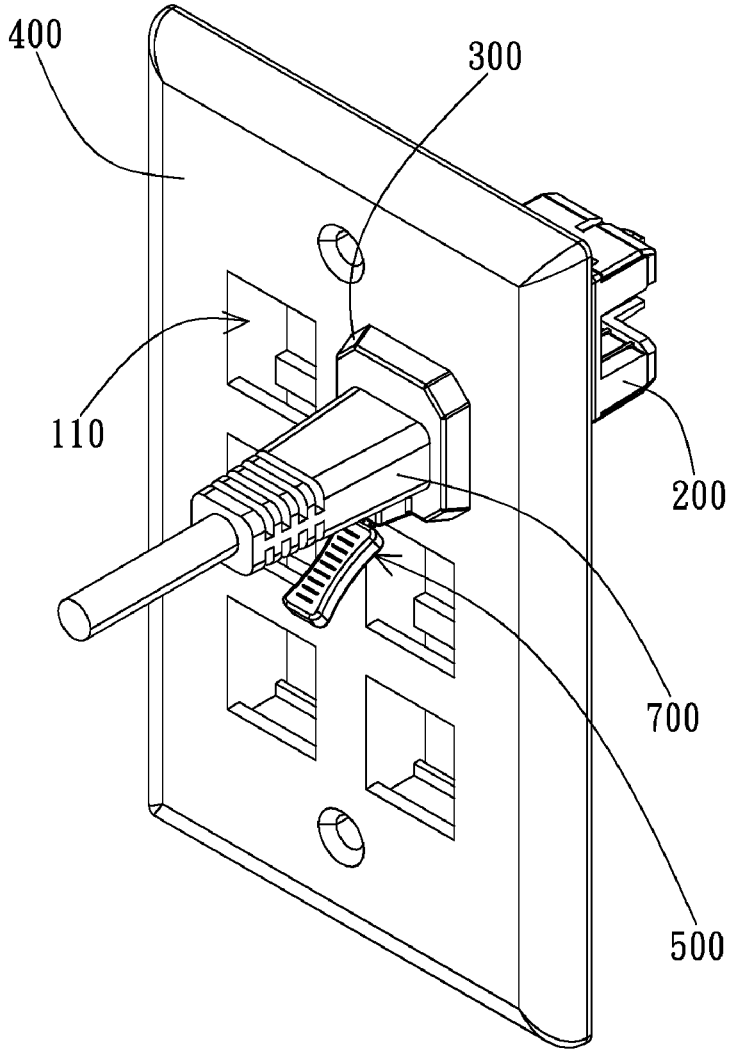
FIG. 6 illustrates a perspective view of a socket device including the security socket assembled with a penal unit of the present invention.
Figure 7:
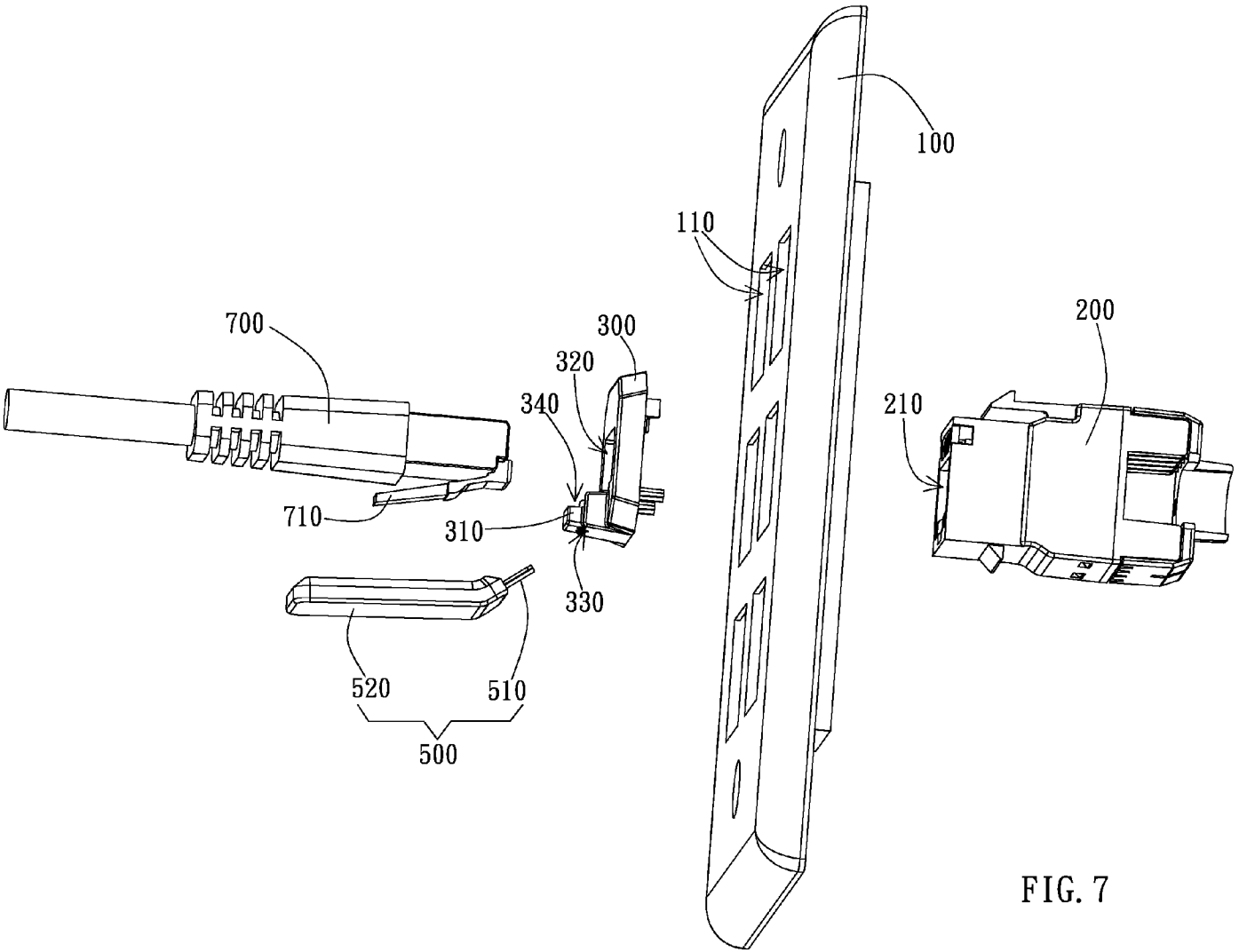
FIG. 7 illustrates an exploded view of the security socket device of the present invention.

As FIG. 6 and FIG. 7 show, a security socket device for use with a connection plug 700 is also provided. In this embodiment, the security socket device includes a panel unit 400, a socket 200, a security unit 300, and a plug remover 500. The panel unit 400 has at least one assembly hole 110. The panel unit 400 may include jump panel, a housing of terminal box or wire-gathering box, or other proper panel used in the communication network system, the telephone wiring system, or other proper connection system. The socket 200 is disposed on the rear side of the panel unit 400 corresponding to the assembly hole 110. The security unit 300 is assembled from the front side of the panel unit 400 corresponding to the assembly hole 110 and engages with the socket 200. That is, the security unit 300 and the socket 200 are assembled through the assembly hole 110 to sandwich the panel unit 400 there between. The engagement mechanism of the socket 200 and the security unit 300 is identical to the embodiment described above and will not be elaborated hereinafter.

In this embodiment, the security unit 300 has a through hole 320 corresponding to the assembly hole 110 of the panel unit 400 and a protrusion 310 extending parallel to the insertion direction of the through hole 320. The protrusion 310 can be a plate-like unit with a recess 340. The protrusion 310 further has an insertion hole 330 on the bottom to communicate with the recess 340. The recess 340 is provided for accommodating a resilient portion 710 of the connection plug 700. When the connection plug 700 is plugged into the slot 210 of the socket 200 through the through hole 320, the resilient portion 710 of the connection plug 700 is received in the recess 340 of the security unit 300, so that the resilient portion 710 is inaccessible from any side of the protrusion 310 except the bottom side. In other words, the resilient portion 710 is protected by the protrusion 310 of the security unit 300 thereby the connection plug 700 cannot be disassembled from the socket 200 without the plug remover 500. When the plug remover 500 is inserted into the insertion hole 330 and pushes the resilient portion 710 of the connection plug 700 away from the recess 340 of the security unit 300, the connection plug 700 is allowed to be disassembled from the slot 210 of the socket 200 by a pulling force opposite to the insertion direction of the connection plug 700.

Generally, the plug remover 500 is kept by the owner, executive officer, or manager of the hotel, apartment, facility, or building. That is, consumers or users usually do not have the plug remover 500 to unplug the connection plug 700 from the socket device. Accordingly, the connection between the connection plug 700 and the socket device is secured and the network cabling system including the panel unit 400 and the slot 210 of the socket 200 is protected from contamination and damage.

In the embodiment shown in the FIG. 7, the shape of the plug remover 500 corresponds to the shape of the insertion hole 330. The details of the shape of the insertion hole 330 and the plug remover 500 is similar to the above-mentioned embodiment and is not elaborated hereinafter. The plug remover 500 includes an inserting portion 510 and a holding portion 520. In the embodiment, the plug remover 500 has a holding portion larger than that of the embodiment shown in FIG. 4. In this embodiment, the holding portion 520 forms an inclined angle with respect to the inserting portion 510, such that user can operate or insert the insertion hole 330 into the insertion hole 330 more conveniently. In addiction, the insertion hole 330 is preferably a tilt-angled through hole to prevent the consumer or user from disassembling the connection plug 700 from the socket 200 imprudently. The tilt-angled insertion hole 330 is a slanted through hole rather than a vertical through hole with respect to the extending direction of the protrusion 310. The details of the insertion hole can be referred to FIG. 5A and FIG. 5B.

Therefore, when the connection plug 700 is inserted into the slot 210 of the socket 200, the resilient portion 710 of the connection plug 700 is received in the recess 340 of the security unit 300, such that the resilient portion 710 is secured in the recess 340 of the protrusion 310. When the plug remover 500 is inserted into the insertion hole 330 and pushes the resilient portion 710 of the connection plug 700 away from the recess 340 of the security unit 300, the connection plug 700 can be unplugged from the slot 210 of the socket 200.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A security socket for use with a panel having at least one assembly hole, an inner surface, and an outer surface, the security socket comprising:

a data socket having a slot connected to the assembly hole of the panel in a direction toward the inner surface of the panel; and a security unit engaging with the data socket in a direction toward the outer surface of the panel, the security unit having a protrusion and a through hole, and the protrusion extending from a surface of the through hole corresponding to the slot of the data socket, wherein the protrusion further has an insertion hole penetrating through a bottom of the protrusion.

2. The security socket of claim 1 further comprising a plug remover, wherein the plug remover has a shape corresponding to the shape of the insertion hole.

3. The security socket of claim 2, wherein the plug remover includes an inserting portion and a holding portion, the dimension of the holding portion is greater than or similar to the dimension of the inserting portion.

4. The security socket of claim 2, wherein the plug remover is inserted into the insertion hole to allow a connection plug with a resilient portion to be removed from the data socket.

5. The security socket of claim 1, wherein the insertion hole includes a tilt angled through hole.

6. The security socket of claim 1, wherein the insertion hole includes a V-shape, T-shape, or a predetermined geometric shape.

7. The security socket of claim 1, wherein the protrusion has a recess for accommodating a resilient portion of a connection plug.

8. The security socket of claim 1, wherein the security unit has at least one fastening portion, and the data socket has at least one engaging portion for engaging with the at least one fastening portion.

9. The security socket of claim 1, wherein the security unit has at least one interfering portion, and the data socket has at least one cavity for engaging with the at least one interfering portion.

10. A security socket device, comprising:

a panel unit having an assembly hole, an inner surface, and an outer surface;

a data socket having a slot assembled to the assembly hole of the panel in a direction toward the inner surface of the panel;

a security unit engaging with the data socket in a direction toward the outer surface of the panel, the security unit having a protrusion and a through hole corresponding to the slot, and the protrusion perpendicularly extending from a surface of the through hole, wherein the protrusion further has an insertion hole penetrating through a bottom of the protrusion; and a plug remover for inserting into the insertion hole.

11. The security socket device of claim 10, wherein the shape of the plug remover corresponds to the shape of the insertion hole.

12. The security socket device of claim 10, wherein the plug remover includes an inserting portion and a holding portion, the dimension of the holding portion is greater than or similar to the dimension of the inserting portion.

13. The security socket device of claim 10, wherein the insertion hole includes a tilt angled through hole.

14. The security socket device of claim 10, wherein the insertion hole includes a V-shape, T-shape, or a predetermined geometric shape.

15. The security socket device of claim 10, wherein the plug remover is inserted into the insertion hole to allow a connection plug with a resilient portion to be removed from the data socket.

16. The security socket device of claim 15, wherein the protrusion has a recess for accommodating the resilient portion.

17. The security socket device of claim 10, wherein the security unit has at least one fastening portion, and the data socket has at least one engaging portion for engaging with the at least one fastening portion.

18. The security socket device of claim 10, wherein the security unit has at least one interfering portion, and the data socket has at least one cavity for engaging with the at least one interfering portion.

* * * * *